US005127543A

United States Patent [19]

Meisels

[11] Patent Number: 5,127,543

[45] Date of Patent: Jul. 7, 1992

[54] DEVICE FOR REDUCING CIGARETTE CONSUMPTION

[76] Inventor: Cheskel Meisels, 1415 - 46th St., Brooklyn, N.Y. 11219

[21] Appl. No.: 577,441

[22] Filed: Sep. 4, 1990

[51] Int. Cl.[5] ..... B65B 59/00

[52] U.S. Cl. ..... 221/4; 221/15; 221/97; 221/151; 221/266; 221/258; 221/281

[58] Field of Search ..... 221/15, 16, 97, 82, 221/83, 97, 151, 266, 258, 281, 265, 4; 222/368, 643

[56] References Cited

U.S. PATENT DOCUMENTS

| | | | |
|---|---|---|---|
| 1,664,546 | 4/1928 | Gilbertson | 221/266 |
| 1,715,726 | 6/1929 | Tomoda | 221/83 |
| 2,793,791 | 5/1957 | Clark | 222/368 |
| 2,819,814 | 1/1958 | Hatch | 221/15 |
| 3,127,069 | 3/1964 | Tygart | 222/368 |
| 3,860,144 | 1/1975 | Marzo | 221/15 |
| 4,308,974 | 1/1982 | Jones | 221/266 |
| 4,573,606 | 3/1986 | Lewis et al. | 221/15 |
| 4,651,619 | 3/1987 | Voecks | 221/151 |

*Primary Examiner*—H. Grant Skaggs

[57] ABSTRACT

A device for reducing cigarette consumption is provided and consists of a container having a hopper compartment therein for holding a plurality of cigarettes. A cover is hinged to the container for normally closing the hopper compartment. A mechanism is carried in the container for allowing the dispensing of one cigarette at a time from the hopper compartment at predetermined timed intervals to make a person cut down on the amount of cigarettes they smoked.

1 Claim, 1 Drawing Sheet

DEVICE FOR REDUCING CIGARETTE CONSUMPTION

BACKGROUND OF THE INVENTION

The instant invention relates generally to apparatuses for inhibiting cigarette smoking and more specifically it relates to a device for reducing cigarette consumption.

Numerous apparatuses for inhibiting cigarette have been provided in the prior art that are adapted to reduce the amount of cigarettes available to a person so as to reduce the number of cigarettes for smoking. For example, U.S. Pat. No. 2,681,560 to Shuttleworth et al, U.S. Pat. No. 3,963,033 to Pope and U.S. Pat. No. 4,076,118 to Karlsson all are illustrative of such prior art. While these units may be suitable for the particular purpose to which they address, they would not be as suitable for the purpose of the present invention as hereafter described.

SUMMARY OF THE INVENTION

A primary object of the present invention is to provide a device for reducing cigarette consumption that will overcome the shortcomings of the prior art devices.

Another object is to provide a device for reducing cigarette consumption that contains a mechanism for allowing the dispensing of one cigarette at predetermined timed intervals so as to make a person cut down on the amount of cigarettes they can smoke.

An additional object is to provide a device for reducing cigarette consumption that contains an audio alarm which will sound at the predetermined timed intervals so that the person may voluntarily choose to release the one cigarette from a container housing cigarettes therein.

A further object is to provide a device for reducing cigarette consumption that is simple and easy to use.

A still further object is to provide a device for reducing cigarette consumption that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
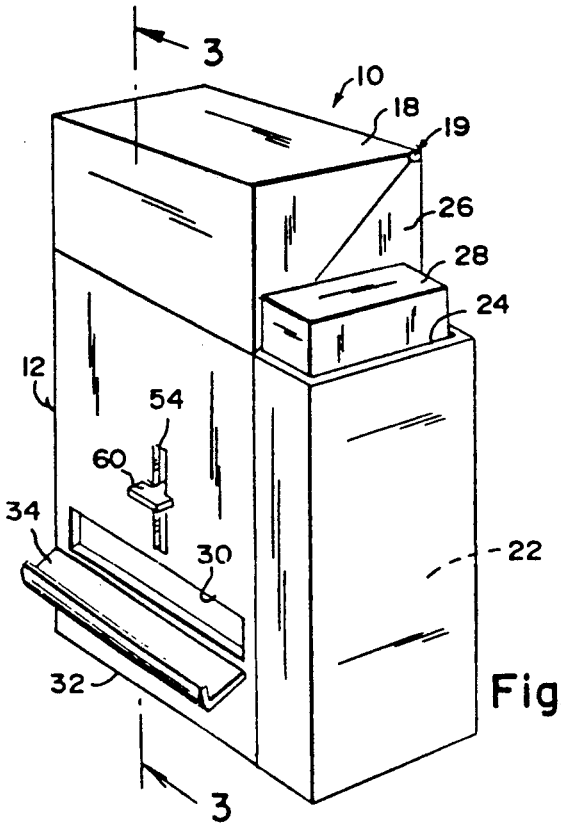
FIG. 1 is a perspective view of the instant invention.
Figure 2:
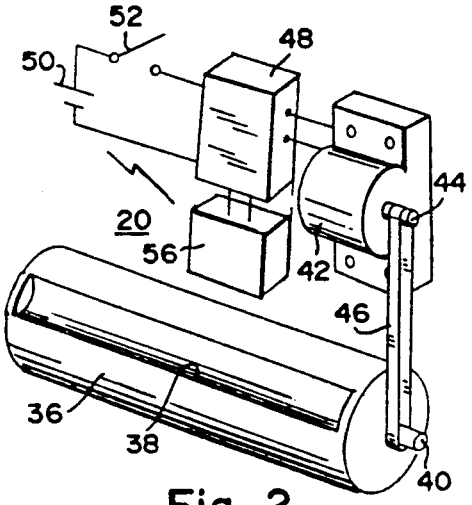
FIG. 2 is an electrical block diagram of the instant invention.
Figure 3:
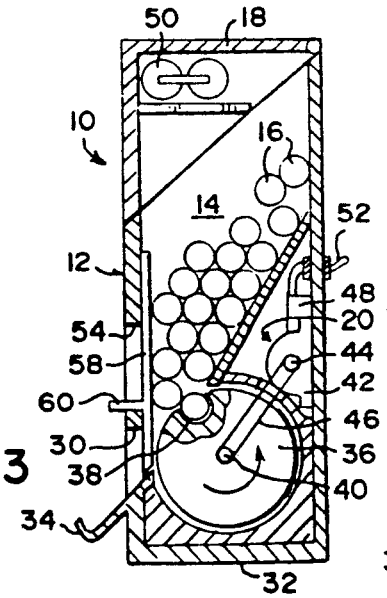
FIG. 3 is a cross sectional view taken on line 3—3 of FIG. 1 of the instant invention illustrating the mechanism just before a cigarette is dispensed.
Figure 4:
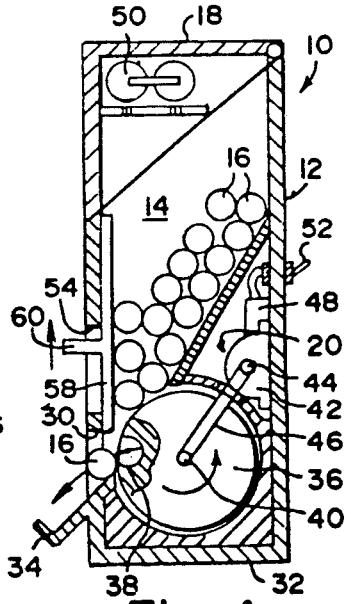
FIG. 4 is a cross sectional view taken on line 3—3 of FIG. 1 of the instant invention illustrating a cigarette being dispensed.

Turning now descriptively to the drawings, in which like reference characters denote like elements throughout the several views, the Figures illustrate a device 10 for reducing cigarette consumption consisting of a container 12 having a hopper compartment 14 therein for holding a plurality of cigarettes 16. A cover 18 that is hinged at 19 to the container normally closes the hopper compartment 14 of the container 12 and is movable to an open position permitting access to the hopper compartment 14 so that the hopper compartment can be filled with the cigarettes 16. A mechanism 20 is carried in the container 12 for allowing the dispensing of one cigarette 16 at a time from the hopper compartment 14 in the container 12 at predetermined timed intervals so as to make a person cut down on the amount of cigarettes 16 they can smoke.

The container 12 further has a second compartment 22 with an open top 24 on the side 26 thereof for removably holding a cigarette lighter 28 therein so that each cigarette 16 dispensed therefrom can be lit by the cigarette lighter 28 when removed from the second compartment 22.

The dispensing mechanism 20 includes the container 12 having a front longitudinal aperture 30 sized to allow a cigarette 16 to exit therethrough. The aperture 30 is located near the bottom 32 of the container 12. An elongated trough 34 is angularly positioned under the front longitudinal aperture 30 to catch the cigarette 16 when it exits through the front longitudinal aperture 30. A drum 36 having a longitudinal recess 38 and a shaft 40 is rotatively mounted under the hopper compartment 14 behind the front longitudinal aperture 30 in the container 12, so that the recess 38 can receive one cigarette 16 and transfer it to exit through the aperture 30 in the container 12 into the trough 34.

An electric reduction gearmotor 42 that has a drive shaft 44, is mounted within the container 12 behind the hopper compartment 14. A continuous belt 46 extends between the drive shaft 44 of the motor 42 and the drum shaft 40. An electric timer 48 within the container 12 is electrically connected to the motor 42 to operate the motor 42 at predetermined timed intervals so that the drum 36 will rotate accordingly. At least one battery 50 is carried in the cover 18 and is electrically connected to the time 48. A switch 52 is carried on the container 12 and is electrically connected between the at least one battery 50 and the timer 48 so as to turn the timer completely on and off when needed.

The container 12 has a front vertical slot 54 directly above the front longitudinal aperture 30. A buzzer 56 within the container is electrically connected to the time 48 to sound an audio alarm signal at each predetermined timed interval. A door member 58 has a handle 60 slideable within the slot 54 in the container 12 so that the door member 58 can be manually operated to ride up and down within the hopper compartment 14 to open and close off the front longitudinal aperture 30, thus allowing the person to choose whether they want to receive the cigarette 16 at each predetermined, timed interval when the buzzer 56 sounds its audio alarm signal.

If a person wants a cigarette 16 they must turn on the switch 52 and wait for the predetermined timed interval in which the buzzer 56 will sound its audio alarm signal. This indicates that the door member 58 should be lifted up since cigarette 16 in the recess 38 of the drum 36 is at the right position to be released. When the door member 58 is lifted up the cigarette 16 will be released to fall into the trough 34. If the person doesn't want the cigarette 16 they will not lift up the door member 58 so that the drum 36 will continue to rotate to the next predetermined time interval.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for reducing cigarette consumption comprising:

a container having a hopper compartment therein for holding a plurality of cigarettes;

said container having a second compartment with an open top on the side thereof for removably holding a cigarette lighter therein so that each cigarette dispensed therefrom can be lit by the cigarette lighter when removed form the second compartment;

a cover hinged to said container for normally closing the hopper compartment of said container and movable to an open position permitting access to the hopper compartment so that the hopper compartment can be filled with cigarettes;

means for allowing the dispensing of one cigarette at a time from the hopper compartment in said container at predetermined timed intervals so as to make a person cut down on the amount of cigarettes they can smoke;

said means for allowing the dispensing of one cigarette at a time comprising said container having a front longitudinal aperture sized to allow a cigarette to exit therethrough, the aperture located near the bottom of said container, an elongated trough angularly positioned under the front longitudinal aperture to catch the cigarette when exiting through the front longitudinal aperture, a drum having a longitudinal recess and a shaft rotatively mounted under the hopper compartment behind the front longitudinal aperture in said container, so that the recess can receive one cigarette and transfer it to exit through the aperture in said container into said trough, an electric motor mounted within the container behind the hopper compartment said motor having a drive shaft, a continuous belt extending between the drive shaft of said motor and the drum shaft, an electric timer within the container electrically connected to said motor to operate said motor at predetermined timed intervals so that said drum will rotate accordingly and at least one battery carried in said cover and electrically connected to said timer;

said container further having a front vertical slot directly above the front longitudinal aperture, a buzzer within said container electrically connected to said timer to sound an audio alarm signal at each predetermined timed interval, and a door member having a handle slideable within the slot in said container so that the door member can be manually operated to ride up and down within the hopper compartment to open and close off the front longitudinal aperture, thus allowing the person to choose whether they want to receive the cigarette at each predetermined timed interval when said buzzer sounds its audio alarm signal.

* * * * *